US009245726B1

(12) United States Patent
Herrero

(10) Patent No.: US 9,245,726 B1
(45) Date of Patent: Jan. 26, 2016

(54) CONTROLLING CHARGED PARTICLES WITH INHOMOGENEOUS ELECTROSTATIC FIELDS

(71) Applicant: The United States of America as represented by the Administrator of the National Aeronautics and Space Administration, Washington, DC (US)

(72) Inventor: Federico A. Herrero, Glenn Dale, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 14/497,247

(22) Filed: Sep. 25, 2014

(51) Int. Cl.

| | |
|---|---|
| ***H01J 49/22*** | (2006.01) |
| ***H01J 49/26*** | (2006.01) |
| ***H01J 49/28*** | (2006.01) |
| ***H01J 49/48*** | (2006.01) |
| ***H01J 47/00*** | (2006.01) |
| ***H01J 40/04*** | (2006.01) |

(52) U.S. Cl.
CPC *H01J 49/22* (2013.01); *H01J 49/48* (2013.01)

(58) Field of Classification Search
USPC ..... 250/281–283, 292, 294, 296, 299, 305, 250/396 R, 492.3, 526
See application file for complete search history.

(56) References Cited

U.S. PATENT DOCUMENTS

| | | | | | |
|---|---|---|---|---|---|
| 4,126,782 | A * | 11/1978 | Usami | H01J 49/482 | 250/305 |
| 8,421,030 | B2 * | 4/2013 | Shadman | H01J 37/05 | 250/305 |
| 2003/0042416 | A1 * | 3/2003 | Goembel | H01J 49/484 | 250/305 |
| 2006/0113467 | A1 * | 6/2006 | Yagita | H01J 37/317 | 250/290 |
| 2006/0113468 | A1 * | 6/2006 | Yagita | H01J 37/05 | 250/290 |
| 2008/0290287 | A1 * | 11/2008 | David | H01J 49/025 | 250/396 R |
| 2011/0147585 | A1 * | 6/2011 | Kholine | H01J 49/484 | 250/310 |
| 2011/0168886 | A1 * | 7/2011 | Shadman | H01J 37/05 | 250/305 |
| 2013/0105687 | A1 * | 5/2013 | Cubric | H01J 49/48 | 250/305 |

* cited by examiner

*Primary Examiner* — Bernard E Souw

(57) ABSTRACT

An energy analyzer for a charged-particle spectrometer may include a top deflection plate and a bottom deflection plate. The top and bottom deflection plates may be non-symmetric and configured to generate an inhomogeneous electrostatic field when a voltage is applied to one of the top or bottom deflection plates. In some instances, the top and bottom deflection plates may be L-shaped deflection plates.

20 Claims, 6 Drawing Sheets

CONTROLLING CHARGED PARTICLES WITH INHOMOGENEOUS ELECTROSTATIC FIELDS

ORIGIN

The invention described herein was made by an employee of the United States Government, and may be manufactured and used by or for the Government for governmental purposes without the payment of any royalties thereon or therefor.

FIELD

The present disclosure relates to an apparatus for controlling charged particles, such as ion and/or electron beams and, more particularly, to an energy analyzer for controlling charged particles using asymmetric inhomogeneous fields.

BACKGROUND

Charged-particle spectrometers may be designed to measure energy and angular distributions of ions and electrons as well as ionic mass. The charged-particle spectrometers may utilize energy analyzers to limit the energy bandwidth of charged-particles that a detector of the charged-particle spectrometer detects. Such energy analyzers may include a parallel plate analyzer or a small deflection energy analyzer.

SUMMARY

Implementations described herein relate to energy analyzers for controlling charged particles, such as ions and/or electron beams using asymmetric inhomogeneous electrostatic fields. The energy analyzer includes a first deflection plate and a second deflection plate with a voltage being applied to one of the first deflection plate or the second deflection plate. The deflection plates may be L-shaped deflection plates such that an inhomogeneous electrostatic field is generated between the plates of the energy analyzer. The energy analyzer also includes an opening aperture through which charged particles, such as ions and/or electron beams, may be received within the energy analyzer. The particles entering near the top of the opening aperture encounter a stronger electrostatic field than the particles entering lower in the opening aperture. Thus, the particles near the top of the opening aperture are deflected by a greater amount than the lower particles due to the inhomogeneous electrostatic field. Similarly, the particles near the bottom of the opening aperture encounter a lesser electrostatic field than the particles entering higher in the opening aperture. Thus, the particles near the bottom of the opening aperture are deflected by a lesser amount than the higher particles due to the inhomogeneous electrostatic field. Because of the varying amounts of deflection of the particles resulting from the inhomogeneous electrostatic field, the particles can be converged via demagnification as the particles travel through the energy analyzer, thereby permitting a smaller exit aperture to be utilized. Such demagnification may lead to a large increase in energy resolution that is offset only by a lessening of focus in an angle $\alpha$ in the energy dispersion plane. The amount of energy resolution and the desirable cone of acceptance, defined by the angle $\alpha$, can be balanced to achieve a desired energy resolution together with a desirable cone of acceptance and aperture size product.

One implementation relates to an energy analyzer having a first deflection plate and a second deflection plate. The first deflection plate and the second deflection plate are not symmetric, and the first deflection plate and the second deflection plate generate an inhomogeneous electrostatic field between the first deflection plate and the second deflection plate when a voltage is applied to one of the first deflection plate or the second deflection plate.

Another implementation relates to a charged-particle spectrometer that includes a detector and an energy analyzer. The energy analyzer includes a first deflection plate and a second deflection plate. The first deflection plate and the second deflection plate are not symmetric, and the first deflection plate and the second deflection plate generate an inhomogeneous electrostatic field between the first deflection plate and the second deflection plate when a voltage is applied to one of the first deflection plate or the second deflection plate.

Yet a further implementation relates to an energy analyzer that includes a first deflector and a second deflector. The first deflector and the second deflector are not symmetric, and the first deflector and the second deflector generate an inhomogeneous electrostatic field between the first deflector and the second deflector when a voltage is applied to one of the first deflector or the deflector.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
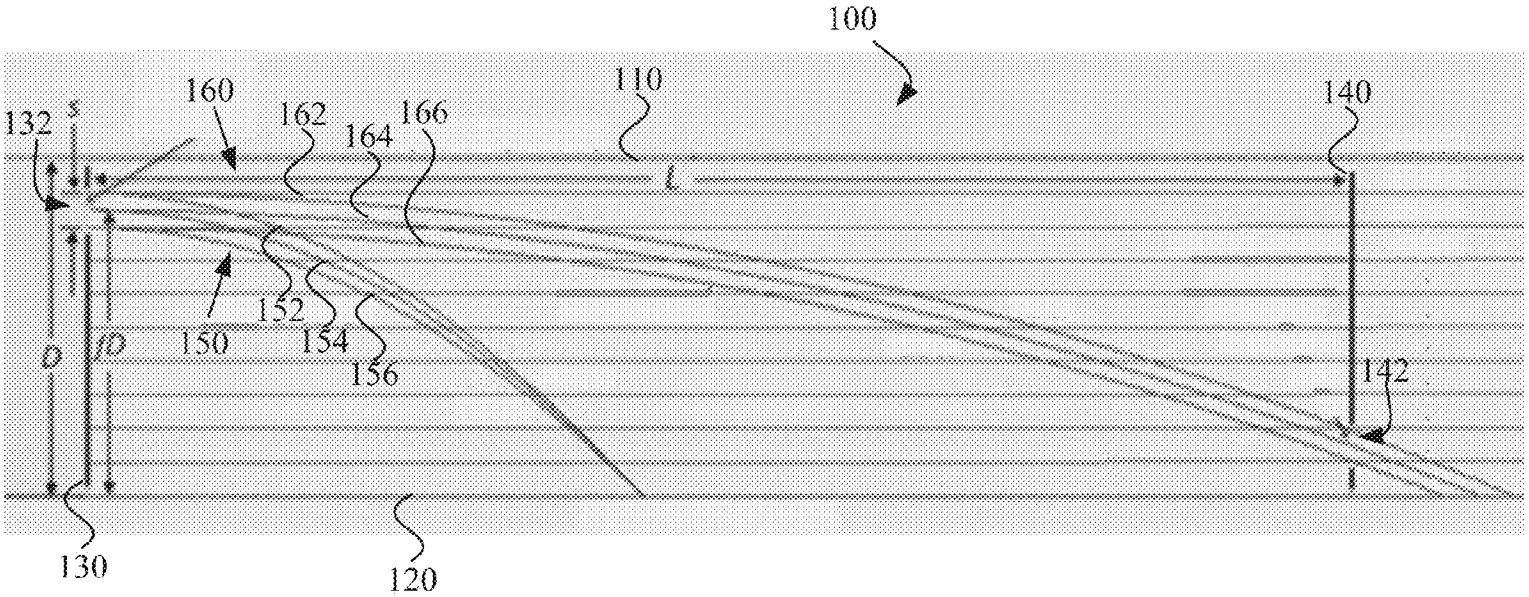
FIG. 1 is a diagram of an implementation of a parallel plate analyzer having a homogeneous electrostatic field and depicting trajectories of several charged particles from an entrance aperture.

It will be recognized that some or all of the figures are schematic representations for purposes of illustration. The figures are provided for the purpose of illustrating one or more embodiments with the explicit understanding that they will not be used to limit the scope or the meaning of the claims.

DETAILED DESCRIPTION

Following below are more detailed descriptions of various concepts related to and implementations of, methods, apparatuses, and systems for energy analyzers for charged-particle spectrometers having inhomogeneous fields. The various concepts introduced above and discussed in greater detail below may be implemented in any of numerous ways as the described concepts are not limited to any particular manner of implementation. Examples of specific implementations and applications are provided primarily for illustrative purposes.

I. Overview

Spectrometers can be used in a variety of situations. For instance, in space plasmas, like the ionosphere, the magnetosphere, and the solar wind, spectrometers may be used to measure the energy and angular distributions of ions and/or electrons. In such instances, the ions and/or electrons may have kinetic energies as high as 50 to 60 keV to be analyzed. Such high kinetic energies of the ions and/or electrons may require voltage supplies that exceed 5 kilovolts to perform measurements, making voltage breakdown a risk in addition to large power consumption. Accordingly, usage of an energy analyzer operating with small deflections may reduce the voltage needed for such measurements. For instance, a small-deflection energy analyzer (SDEA) for a spectrometer can introduce small deflections to the particles to reduce the electrical power needed, such as measuring 60 keV energies with using 3 kilovolts of power. However, such SDEAs have used parallel plate analyzers, which do not focus the particles. Accordingly, it may be useful to have an SDEA that can focus the particles to obtain better performance in energy resolution, aperture area, and field of view.

Such lack of focusing of particles may be eliminated through the use of an inhomogeneous electrostatic field for the SDEA in the space between metallic deflection plates. The inhomogeneous electrostatic field may be used to control ion and/or electron beam size in conjunction with aperture size to obtain improved performance in energy resolution-aperture area-and field of view. Trajectories of the ions and/or electrons near the upper part of an entrance aperture experience a stronger electrostatic field than those near the lower part of the entrance aperture, thereby developing a net convergence in the transmitted trajectories. The net effect is a very small magnification m (less than 0.01) of the entrance aperture at the exit aperture plane. The energy resolution of the energy analyzer is enhanced by the factor 1/m, allowing very large entrance aperture sizes for enhanced sensitivity. The inhomogeneous electrostatic field may be generated using non-symmetric deflections plates, such as L-shaped deflection plates. The usage of such deflection plates still permits the geometric advantages of an SDEA, such as the ability to stack multiple SDEAs side by side to increase net sensitivity of an ion or electron spectrometer, but also may result in reduced spectrometer exit slits for improved photon rejection and reduced voltage breakdown risk.

II. Operation of an Implementation of an Energy Analyzer

For an energy analyzer of a charged-particle spectrometer, the energy analyzer sets up an electric field using a known voltage, V, that is applied to one or more deflection plates or deflectors. Ions or electrons enter the analyzer through an entrance aperture and deflect according to the ion's or electron's kinetic energy, and the energy is obtained from a measurement of the ion or electron deflection. The deflection may be measured by the ion or electron position, y, at the exit plane of the analyzer. That is, the energy of an ion or electron may be determined based on the vertical deflection of the ion or electron relative to the deflector plates. Another plane in which the ions or electrons deflect is the dispersion plane. That is, the ions or electrons may deflect in a horizontal direction relative to the entrance aperture. Ions or electrons enter the spectrometer via the entrance aperture moving along this plane at an angle, a, with respect to the spectrometer axis. Thus, for a given the plate voltage V and the geometry of the energy analyzer, the ion or electron deflection is a function of ion's or electron's kinetic energy E and angle of incidence $\alpha$ and may be written as the function $y(E; \alpha)$.

If the energy analyzer operates with an exit aperture at an exit plane, the energy may be scanned or selected by adjusting the applied voltage V. That is, depending upon the voltage selected, certain energies of ions or electrons will pass through the exit aperture while other ions or electrons entering the entrance aperture will not exit the energy analyzer via the exit aperture. This is because the applied voltage either does not deflect the ions or electrons enough for them to exit the exit aperture or deflects them more than needed to exit via the exit aperture. For any value of V there will be a mean transmitted energy, $E_0$, from the ions or electrons that exit via the exit aperture. Also, in order for the ions or electrons to pass the exit slit at energy $E_0$, they must enter the energy analyzer along some mean angle of incidence $\alpha_0$. The deflection variation for the ions or electrons due to changes $\Delta\alpha$ and $\Delta E$ about these mean values can be defined as:

$$\Delta y = \left(\frac{\partial y}{\partial \alpha}\right)_{E_0} \Delta\alpha + \left(\frac{\partial y}{\partial E}\right)_{\alpha_0} \Delta E = g(E_0)\Delta\alpha + d(\alpha_0)\Delta E$$

where the first coefficient $g(E_0)=(\partial y/\partial \alpha)\, E_0$ is the slope of the deflection function for fixed energy. The second coefficient $d(\alpha_0)=(\partial y/\partial E)_{\alpha 0}$, which is the dispersion of the energy analyzer, provides a measure of how well the energy analyzer separates different energies. In an application, $\Delta y$ may be attempted to be kept as small as possible. However, it may also be desirable to have a large $\Delta\alpha$ to ensure as large a cone of acceptance for the energy analyzer. Also, a small $\Delta E$ may be needed to meet energy resolution requirements while, at the same time, large dispersion is usually required to minimize the size of the exit slit. The condition for focusing in a is met if $g(E_0)=0$. For small deflection energy analyzers (SDEA), $g(_{E00})\neq 0$, but this disadvantage is offset by the effect of the inhomogeneous field inside the SDEA.

In order to obtain an expression to optimize the energy resolution in a SDEA, the functional relation is rewritten to give the energy of transmitted ions as $E(\alpha, y)$. In terms of this function, the uncertainty in the energy of the transmitted ions is $$\Delta E = \left(\frac{\partial E}{\partial \alpha}\right)_y \Delta\alpha + \left(\frac{\partial E}{\partial y}\right)_\alpha \Delta y$$

where the angle uncertainty is $\Delta\alpha$ and the deflection uncertainty is $\Delta y$. Since $$\left(\frac{\partial E}{\partial \alpha}\right)_y = \left(\frac{\partial E}{\partial y}\right)_\alpha \left(\frac{\partial y}{\partial \alpha}\right)_E$$

and with the deflection function being $y=y(E, \alpha)$, it is possible to express $\Delta E$ as $$\Delta E = \left(\frac{\partial E}{\partial y}\right)_\alpha \left(\Delta y + \left(\frac{\partial y}{\partial \alpha}\right)_E \Delta\alpha\right) = \frac{1}{d(\alpha_0)}(\Delta y + g(E)\Delta\alpha)$$

This expression indicates that the dispersion, d, must be as large as possible to minimize ΔE. It also indicates that Δy and $g(E_0)$ must be controlled to achieved a desired performance.

III. Implementation of a Parallel Plate Energy Analyzer

FIG. 1 depicts an implementation of a parallel plate energy analyzer 100. The energy analyzer 100 includes a top deflection plate 110, a bottom deflection plate 120, an entrance plate 130 and an exit plate 140. The entrance plate 130 includes an entrance aperture 132 through which ions and/or electrons are permitted to enter the energy analyzer 100. The top deflection plate 110 has a voltage V applied to it while the bottom deflection plate 120 has zero voltage applied to it. The voltage V applied to the top deflection plate 120 causes a vertical homogeneous electrostatic field to be generated between the top deflection plate 120 and the bottom deflection plate 130. Because of the electrostatic field, a parallel bundle 150, 160 of ions and/or electrons having trajectories with finite heights experience focusing due to the difference in kinetic energy retardation between the upper 152 and lower 156 parts of the bundle 150 as they enter the energy analyzer 100. That is, as ions and/or electrons enter the energy analyzer 100 via the entrance plate 110, the ions and/or electrons near the top of the entrance aperture 132 encounter a higher potential of the electrostatic field than the ions and/or electrons near the bottom of the entrance aperture 132. Therefore, initially parallel ion and/or electron trajectories converge due to differential deceleration of ions and/or electrons between the trajectories near the top of the entrance aperture 132 and the ions and/or electrons near the bottom of the entrance aperture 132. In some implementations, the deflection of the ions and/or electrons via the energy analyzer 100 uses only small deflections of ion and/or electron trajectories. A small deflection may be one in which the trajectory angle at the exit plate 140 is less than 45°.

FIG. 1 shows two parallel bundles 150, 160 entering the energy analyzer 100 via the entrance aperture 132 horizontally from the left. The three trajectories 152, 154, 156, 162, 164, 166 in each bundle 150, 160 represent the multitude of trajectories that would fill the entrance aperture 132. In one bundle 150, the ions or electrons enter with a lower kinetic energy, such as 1.65 eV, and the other bundle 160 of ions or electrons may enter with a higher kinetic energy, such as 5.9 eV. The downward electrostatic field between the top deflection plate 110 and the bottom deflection plate 120 deflect the ions or electrons in a downward direction toward the bottom deflection plate 120. In an implementation, the voltage potential of the top deflection plate 110 is +1 volt and the voltage potential of the bottom deflection plate 120 is 0 volts with the plates 110, 120 separated by distance D and the horizontal distance to the exit plate 140 and exit aperture 142 from the entrance plate 130 is L. The electrostatic field formed by the voltage applied to the top deflection plate 110 and bottom deflection plate 120 is homogeneous, points downward, and can represented by nine equidistant equipotential straight lines between the top deflection plate 110 and bottom deflection plate 120. The representations of the equipotential lines can vary by differing in steps based on the voltage applied to the top deflection plate 110 and the bottom deflection plate 120. For instance, for a 1.0 voltage applied to the top deflection plate 110, the equipotential straight lines may be lines representative of 0.1 voltage changes from 1.0 at the top deflection plate 110 to 0 at the bottom deflection plate 120. The entrance aperture 132 is has a height, s, and is centered at a distance, fD, above the bottom plate, where f is less than 1.0. That is, f is representative of the percentage distance of the entire height, D, of the entrance plate 110. In the implementation shown in FIG. 1, s=0.1 D and f=0.85. Upon entering the entrance aperture 132, the ions and/or electrons are decelerated by the electrostatic potential at the equipotential line encountered within the energy analyzer 100. For instance, for a voltage of 1.0 applied to the top deflection plate 110, the three ion trajectories 152, 154, 156 of the bundle 150 in the low energy bundle, such as those having a kinetic energy of 1.65 eV, are decelerated to kinetic energies of 0.85, 0.80, and 0.75 eV, respectively, losing approximately less than half of the kinetic energy due to the electrostatic field. Similarly the trajectories 162, 164, 166 of the 5.9 eV bundle 160 are decelerated to 5.1, 5.05, and 5.0 eV, respectively. These energy differences in the bundles lead to focusing since the slower parabolic trajectories 152, 162 near the top of each bundle 150, 160 deflect more than the trajectories 156, 166 at the bottom. The effect is more noticeable in the low energy bundle 150 and less so in the high energy bundle 160 because of the relative difference in kinetic energy relative to the voltage applied to the top deflection plate 110.

The focus of the 1.65 eV trajectories 152, 154, 156 illustrates the importance of early energy control to use the largest part of the trajectory to achieve focus. In addition, the energy analyzer 100 results in a demagnification, m, to the bundle 150 from the entrance aperture 132. That is, if the entrance aperture 132 has size of 0.1 D, then the bundle 150 is focused to a smaller spot where the three trajectories 152, 154, 156 converge toward a single point. However, due to the lower energy of the 1.65 eV trajectories 152, 154, 156, the bundle 150 encounters the bottom deflection plate 120 before the convergence. In contrast, the 5.9 eV trajectories 162, 164, 166 exit the energy analyzer 100 in between the top and bottom deflection plates 110, 120 at an exit aperture 142 of the exit plate 140. A detector may be positioned behind the exit plate 140 to detect the particles that exit via the exit aperture 142 after the small angular deflection induced by the energy analyzer 100.

In some implementations, a plate factor, P, can be defined as the kinetic energy of the detected particles divided by the required voltage, V, to deflect the ions and/or electrons out of the exit aperture 142. For instance, the analysis of the ions and/or electrons of the bundle 160 of FIG. 1 require a plate voltage of only 1.0 volts and thus the energy analyzer 100 has a plate factor, P, of 5.9. For ions and/or electrons having higher kinetic energy, such as 50,000 eV, an applied voltage of about 8,500 volts would be required to be applied to the top deflection plate 110 to analyze the ions and/or electrons.

For the small deflection energy analyzer 100 of FIG. 1 having the exit aperture 142 on the exit plate 140, it is possible to estimate the energy resolution as ΔE/E=sl((2f−1)D), under the assumption that the exit aperture 142 has the same height as the entrance aperture 132. For instance, for an entrance aperture 132 having a height dimension of s=0.1 D and a position of f=0.85, the energy resolution for the exit aperture 142 is ΔE/E=0.143. While this is a good resolution for such a large exit aperture 142, an improvement to the energy resolution may be obtained through the use of an inhomogeneous electrostatic field.

The deflection function of the ideal parallel plate energy analyzer 100 may be obtained from the parabolic trajectories that occur in the uniform electrostatic field. The deflection function of the trajectories, in D units is:

$$y(E,\alpha) = \frac{L}{D}\tan(\alpha) - \frac{1}{2}\left(\frac{L}{D}\right)^2 \frac{qV}{E}\frac{1}{\cos^2(\alpha)}$$

which can be inverted to obtain E(α, y). The deflection and dispersion functions for the ideal parallel plate energy analyzer 100 can be defined as $$g(E_0) = \frac{L}{D}\sec^2(\alpha)\left(1 - \left(\frac{L}{D}\right)\frac{qV}{E_0}\tan(\alpha)\right)$$

and $$d(\alpha_0) = \frac{qV}{2E^2}\left(\frac{L}{D}\right)^2\sec^2(\alpha_0)$$

Thus, the deflection and dispersion of the ions and/or electrons through the energy analyzer 100 may be determined using the aforementioned equations.

IV. Implementation of an Inhomogeneous Electrostatic Field Energy Analyzer

Figure 2:
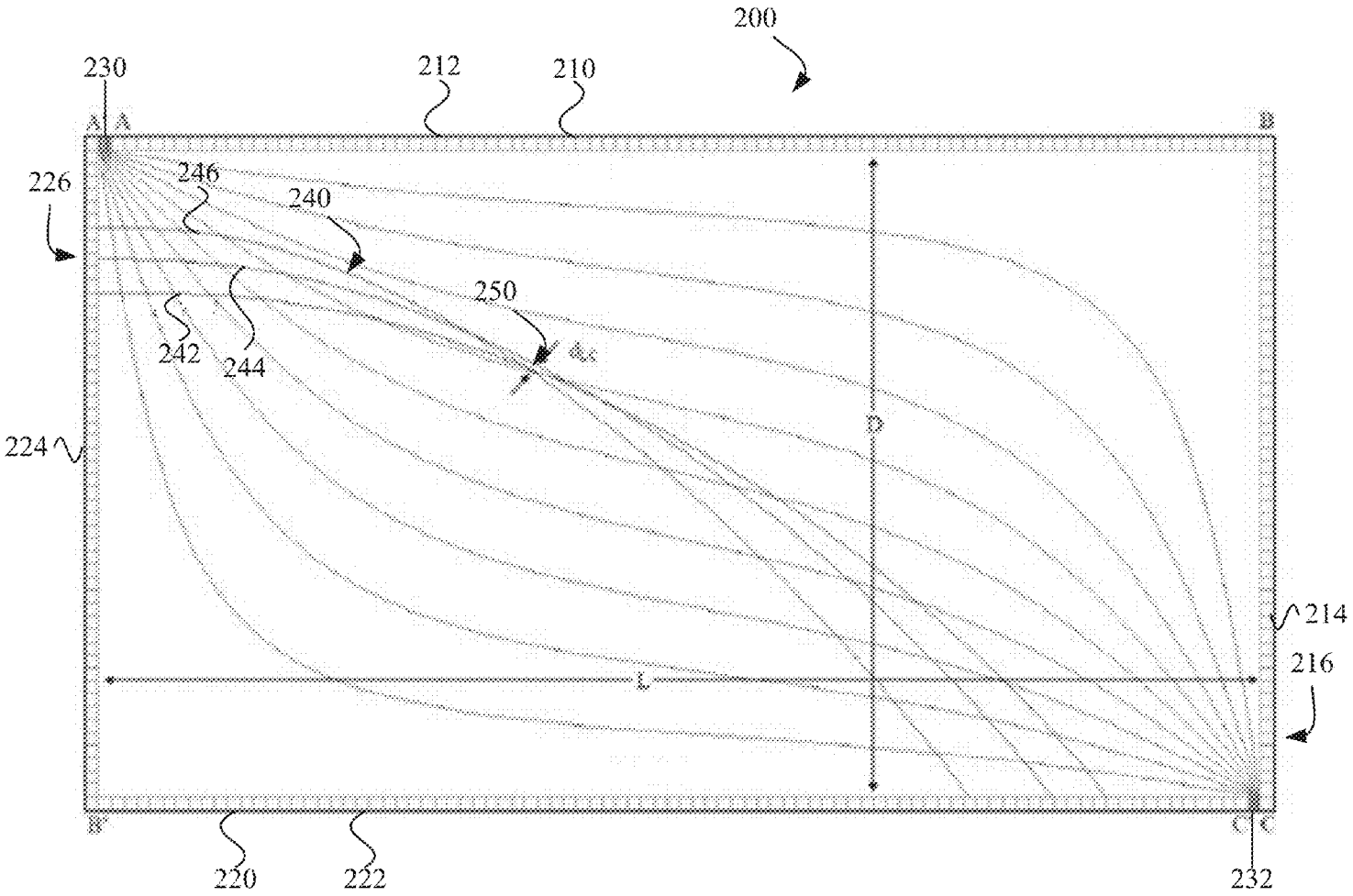
FIG. 2 is a diagram of an implementation of an energy analyzer having a first deflection plate and a second deflection plate generating an inhomogeneous electrostatic field and depicting trajectories of several charged particles from an entrance aperture.

FIG. 2 depicts an example energy analyzer 200 that generates an inhomogeneous electrostatic field. The energy analyzer 200 includes a top deflection plate 210 and a bottom deflection plate 220. The top and bottom deflection plates 210, 220 are each L-shaped deflection plates having a first horizontal portion 212, 222 and a second vertical portion 214, 224. The second vertical portion 224 of the bottom deflection plate 220 includes an entrance aperture 226 formed in a portion of the second vertical portion 224. The second vertical portion 214 of the top deflection plate 210 includes an exit aperture 216 formed in a portion of the second vertical portion 214. Thus, ions and/or electrons may enter the energy analyzer 200 via the entrance aperture 226 and deflect under the influence of an inhomogeneous electrostatic field formed by a voltage applied to the top deflection plate 210 and the bottom deflection plate 220 having no voltage applied. The electrostatic field is represented by the non-horizontal, non-parallel equipotential lines. Two small gaps 230, 232 between the top deflection plate 210 and the bottom deflection plate 220 are responsible for the strong inhomogeneous fields at the small gaps 230, 232, depicted by the equipotential lines converging as they approach the small gaps 230, 232. The strength of the electrostatic field is strongest in the gaps where the distances between neighboring equipotential lines are least due to the closeness of the top deflection plate 210 and the bottom deflection plate 220.

A bundle 240 of trajectories of ions and/or electrons is shown entering the energy analyzer 200 via the entrance aperture 226. The effect of the inhomogeneous field on the three trajectories 242, 244, 246 entering horizontally from the left in the upper half of the energy analyzer 200 is evident in the strong convergence of the trajectories 242, 244, 246. The three trajectories 242, 244, 246 represent a horizontal parallel bundle 240 having a bundle height of 0.1 D (representing the entrance aperture size s), where D is the height distance between the top and bottom deflection plates 210, 220 having a length L. Two of the three trajectories 242, 246 are the limiting trajectories, which can be analogous to the limiting rays in optics, at the upper and lower edges of the parallel bundle 240. The middle trajectory 240, which can be considered the chief trajectory or ray of the ions and/or electrons, represents an average for the entire bundle 240. The top limiting trajectory or ray 246 enters the energy analyzer 200 in a region where the inhomogeneous electrostatic field is strongest. Thus, the top trajectory 246 experiences the largest perturbation as it enters the energy analyzer 200. Since this perturbation is applied early in the trajectory of the top trajectory 246, the effect of the perturbation has the remaining length of the trajectory to deflect ions and/or electrons traveling along the trajectory. As a consequence, the top trajectory 246 undergoes the largest deflection due to the inhomogeneous field generated by the top deflection plate 210 and the bottom deflection plate 220. Similarly, the bottom limiting trajectory or ray 242 undergoes the least deflection due to the inhomogeneous field generated by the top deflection plate 210 and the bottom deflection plate 220. The middle trajectory 244 or chief ray undergoes a deflection intermediate between the top and bottom limiting trajectories 242, 246.

The net convergence of an initially parallel bundle 240 is a focusing effect, though the trajectories 242, 244, 246 of the ions and/or electrons do not come to a specific convergence point. That is, the inhomogeneous electrostatic field of the energy analyzer 200 does not focus a parallel bundle 240 perfectly to a point, but it does develop a disk of least confusion 250. The disk of least confusion 250 is the point where the trajectories 242, 244, 246 of the bundle 240 of ions and/or electrons form the smallest area. Tracing the three trajectories 242, 244, 246 to the region where they converge, the top trajectory 246 and the middle trajectory 244 intersect first, followed by the top trajectory 246 and the bottom trajectory 242, and lastly the bottom trajectory 242 and the middle trajectory 244. The three intersecting points define a small triangle and the perpendicular distance from second point, where the top trajectory 246 and the bottom trajectory 242 intersect, to the middle trajectory segment may be used as a diameter for the disk of least confusion of the parallel bundle 240, which gives a quantitative measure of the aberration that results in the lack of a specific convergence point. The position of the disk of least confusion 250, $d_{LC}$, moves to the right toward the exit plane defined by the second vertical portion 224 of the bottom deflection plate 220 as the parallel bundle 240 is moved downward along the second vertical portion 214 of the top deflection plate 210. That is, as the parallel bundle 240 moves away from the strong inhomogeneous field at the small gap 230. An increase in the kinetic energy of the trajectories 242, 244, 246 will also move the disk of least confusion 250 to the right as well.

Figure 3:
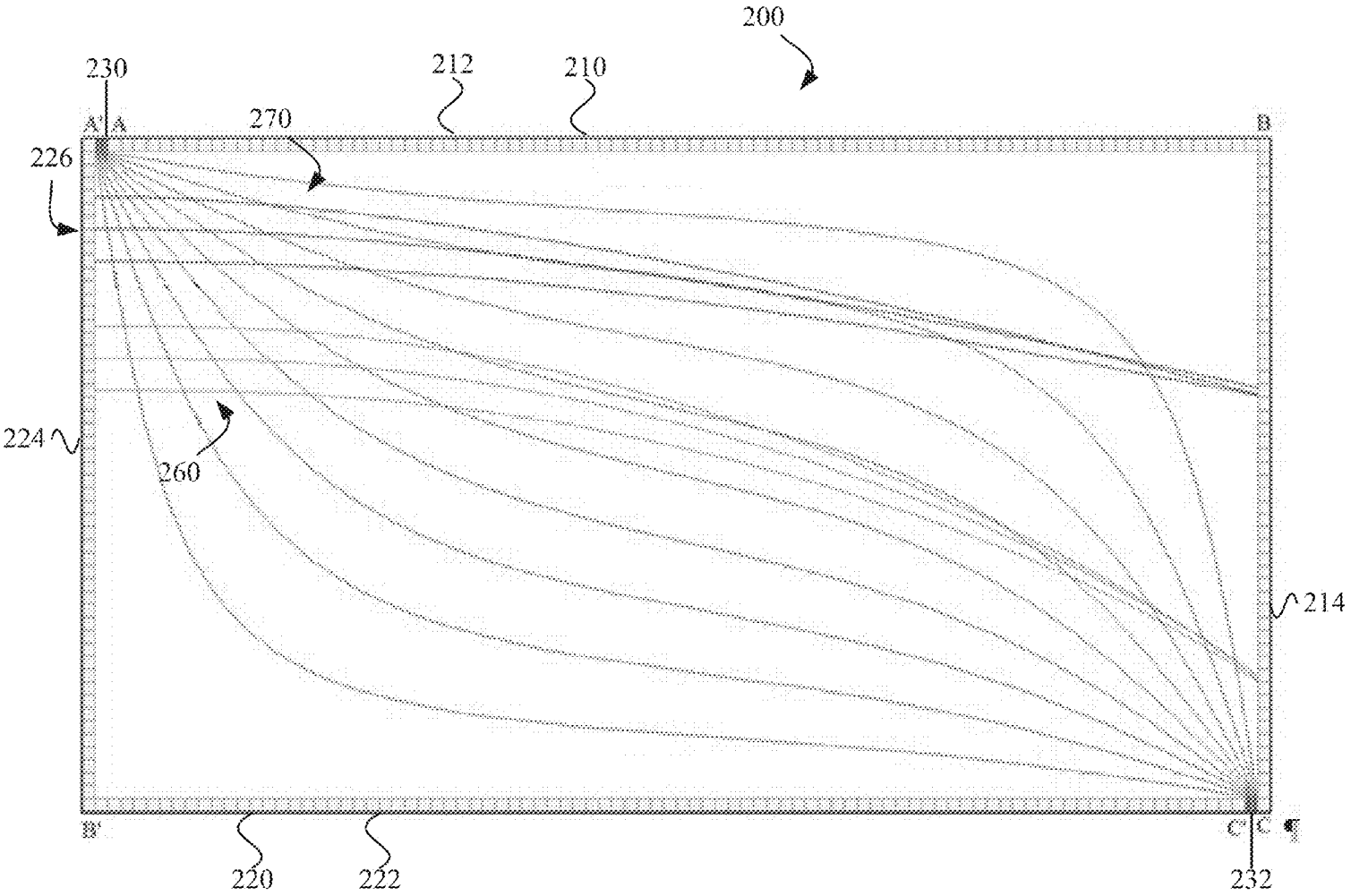
FIG. 3 is a diagram of an implementation of an energy analyzer generating an inhomogeneous electrostatic field and depicting trajectories of several charged particles from a first entrance aperture and a second aperture at different energies.

For instance, as shown in FIG. 3, two parallel bundles 260, 270 are shown entering through different heights of entrance apertures 216 at distances of 0.70 D and 0.90 D, respectively, above first horizontal portion 222 of the bottom deflection plate 220. In addition, the energies of the two parallel bundles 270, 260 are 2.33 and 5.67 eV, respectively, that place the disk of least confusion for each at the exit plane defined by the second vertical portion 224 of the bottom deflection plate 220. As shown in FIG. 3, the bundle 270 closest to the strong inhomogeneous field at the small gap 230 has the largest disk of least confusion because the electrostatic field gradient is largest nearest the small gap 230. This effect also demonstrates that the inhomogeneous electrostatic field demagnifies the bundles 260, 270 from the entrance aperture 216 so that the bundles 260, 270 are smaller at the exit plane.

Figure 4:
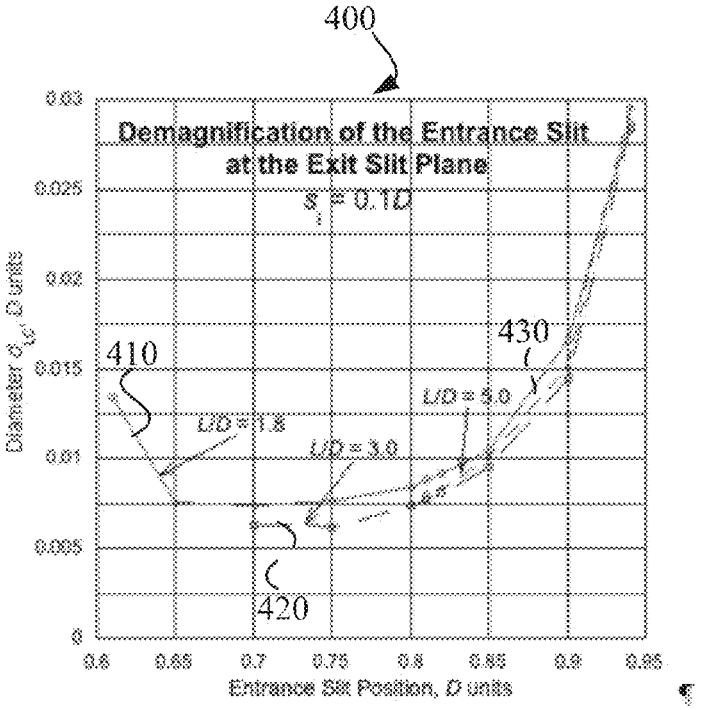
FIG. 4 is a graphical diagram depicting the position of a disk of least confusion relative to an entrance aperture position for varying aspect ratio energy analyzers.

For both FIGS. 2 and 3, the energy analyzers 200 show SDEAs having an aspect ratio L/D=1.8. FIG. 4 depicts a graph 400 of the demagnification effect on trajectories for SDEAs having aspect ratios of 1.8, 3.0, and 5.0. The graph 400 shows the demagnification effect via lines 410, 420, 430 representative of the aspect ratios 1.8, 3.0, 5.0, respectively, for an entrance aperture having a size of 0.1 D as a function of entrance aperture position. The ordinate shows the diameter of the disk of least confusion, $d_{LC}$, normalized to D, the separation between the top and bottom deflection plates. The graph 400 demonstrates that the position of the entrance aperture reaches minimum value around 0.0063 D at entrance aperture positions near 0.7 D for the larger aspect ratios of 3.0 and 5.0. The 1.8 aspect ratio reaches a minimum value of about 0.075 D. The demagnification, m, achieved by the inhomogeneous field is about m=0.063. Thus, the size of a bundle of particles can be reduced to approximately $1/15^{th}$ of the entrance aperture size at the exit plane of the SDEA. Thus, the exit aperture size may also be reduced based on the demagnification from the inhomogeneous electrostatic field.

Figure 5:
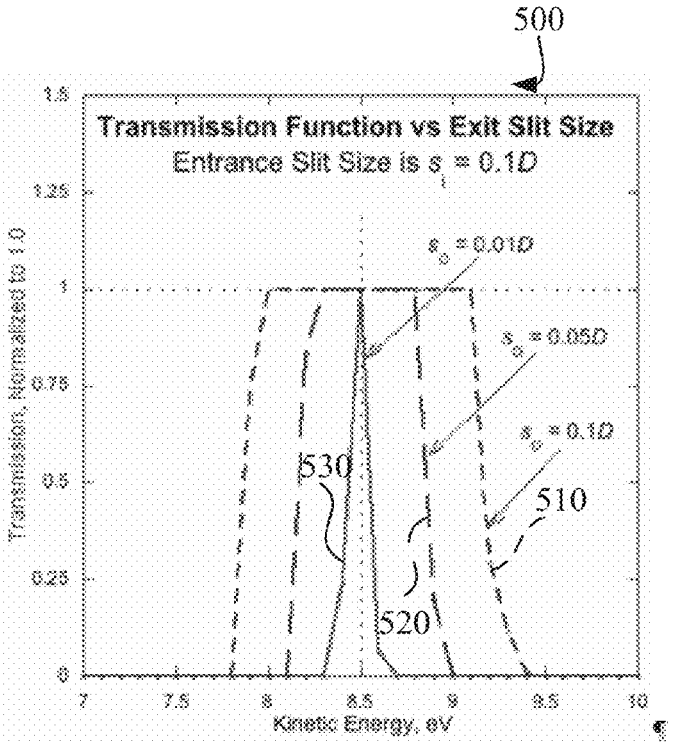
FIG. 5 is a graphical diagram depicting a normalized transmission function relative to varying exit aperture sizes.

The demagnification of the bundle of particles can also be used to increase the energy resolution by reducing the exit aperture size. FIG. 5 depicts several transmission bandpasses 510, 520, 530 for an SDEA having an aspect ratio L/D=1.8 and entrance aperture size of $s_i$=0.1 D located at 0.85 D on the second vertical portion of the bottom deflection plate for three exit aperture sizes, $s_o$, of 0.1 D, 0.05 D, and 0.01 D for the transmission bandpasses of 510, 520, 530, respectively. The energy resolution, R, is the full width at half-maximum ΔE of the bandpass 510, 520, 530 divided by the mean energy E, or R=ΔE/E. The three exit apertures result in energy resolutions of 0.15, 0.08, and 0.014, respectively. The shape of bandpass is trapezoidal for the lower resolutions of 0.15 and 0.08, and a triangular shape for the better resolution of 0.014. In some implementations, the energy resolution may be proportional to the demagnification, m, from the entrance aperture to the exit aperture. That is, the energy resolution may be changed by a factor of 1/m. The size of exit aperture, $s_o$, may be defined by the demagnification factor and the entrance aperture, $s_i$, such as $s_o=ms_i$. The ability to reduce the exit aperture size can reduce unwanted photon flux in space applications. If energy resolution is not needed, a lower energy resolution may be used and a spectrometer aperture area, A, and solid angle of acceptance cone, ΔΩ, may be increased. The spectrometer aperture area, A, and solid angle of acceptance cone, ΔΩ, may define a geometric factor, G, where the geometric factor is G=A×ΔΩ.

Figure 6:
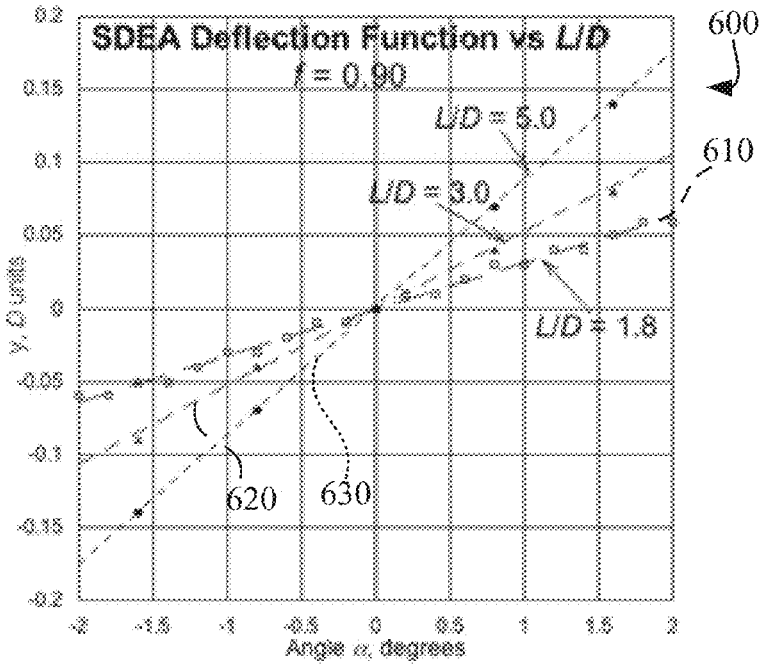
FIG. 6 is a graphical diagram depicting the deflection of charged particles relative to an angle of incidence for varying aspect ratio energy analyzers.
Figure 7:
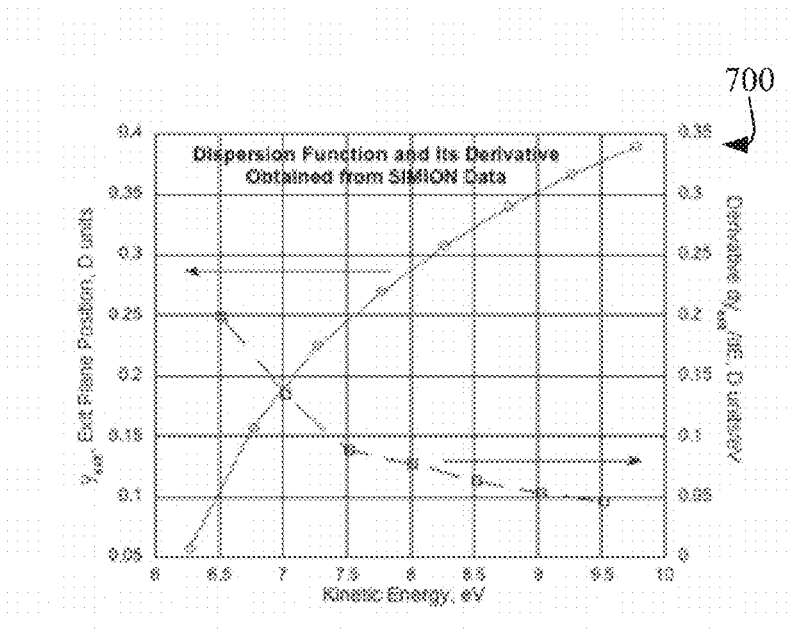
FIG. 7 is a graphical diagram depicting a minimum position along an exit plane for a charged particle and a derivative of the dispersion function as a function of incident kinetic energy.

Optimizing energy resolution relative to the geometric factor may require knowledge of the deflection function, g(E), and the dispersion coefficient, d(a), defined above. FIG. 6 depicts a graph 600 of deflection values with fitted lines 610, 620, 630 determined using SIMION® for the three L/D aspect ratios for energy analyzers having an entrance aperture positioned at 0.9 D relative to the bottom deflection plate. The deflection values are calculated for a range of acceptance angles α from −2° to 2°. The slope of the fitted lines 610, 620, 630 gives the deflection function g(E) to estimate ΔE. In some implementations, the smallest value of g(E) is used. The graph 600 indicates that the smallest slope is for the aspect ratio of L/D=1.8 and has a value of approximately 0.032 D units/degree. FIG. 7 depicts another graph 700 showing values for the dispersion function, d(α), for the aspect ratio of L/D=1.8. The graph 700 also depicts the displacement of the disk of least confusion along the vertical exit plane as a function of the incident kinetic energy. In the graph shown, a minimum value of d(α)=0.2 D units/eV is obtained at a kinetic energy of 6.5 eV.

The inhomogeneous electrostatic field of the energy analyzer 200 discussed herein can result in an increase in energy resolution which is offset only by a reduced angle α in the energy dispersion plane for the cone of acceptance at the entrance aperture. For SDEAs, it is possible to trade off a lesser energy resolution for an increased angle α or have a greater energy resolution for a decreased angle α to achieve a desired energy resolution and cone of acceptance for ions and/or electrons.

Figure 8:
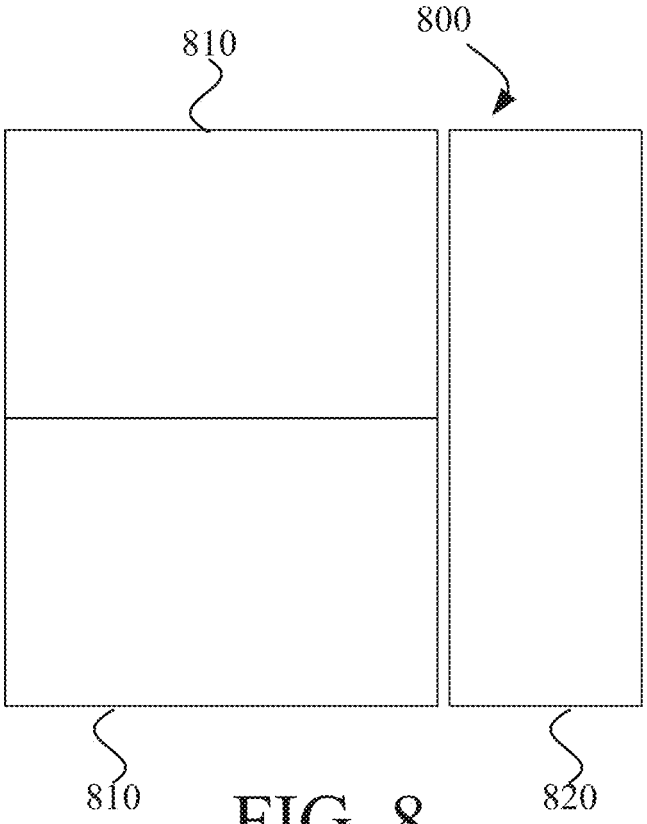
FIG. 8 is a block diagram for a charged-particle spectrometer having multiple energy analyzers and a detector.

FIG. 8 depicts a block diagram of a charged-particle spectrometer 800 having multiple energy analyzers 810 and a detector 820 for detecting ions and/or particles from the energy analyzers 810. The energy analyzers 810 may be constructed in a similar manner to the energy analyzer 200 of FIGS. 2-3. The ions and/or electrons that exit the exit apertures of the energy analyzers 810 encounter a detector 820 that may generate a signal indicative of the detection of the ions and/or electrons. In some implementations, the energy analyzers 810 may be SDEAs. The geometric advantages of the SDEAs permit multiple SDEAs to be stacked side by side to increase net sensitivity of the ion or electron spectrometer 800.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An energy analyzer comprising:

a first deflection plate; and a second deflection plate, wherein the first deflection plate and the second deflection plate are not symmetric, and wherein the first deflection plate and the second deflection plate generate an inhomogeneous electrostatic field between the first deflection plate and the second deflection plate when a voltage is applied to one of the first deflection plate or the second deflection plate.

2. The energy analyzer of claim 1, wherein the first deflection plate comprises a first L-shaped deflection plate.

3. The energy analyzer of claim 2, wherein the first L-shaped deflection plate comprises a first portion having a height and a second portion having a length, wherein the height and the length are not equal.

4. The energy analyzer of claim 3, wherein the second deflection plate comprises a second L-shaped deflection plate comprising a third portion and a fourth portion, the third portion substantially parallel to the first portion of the first L-shaped deflection plate and the fourth portion substantially parallel to the second portion of the first L-shaped deflection plate.

5. The energy analyzer of claim 4, wherein the first portion of the first L-shaped deflection plate comprises an entrance aperture and third portion of the second L-shaped deflection plate comprises an exit aperture.

6. The energy analyzer of claim 5, wherein a dimension of the exit aperture is less than a dimension of the entrance aperture.

7. The energy analyzer of claim 5, wherein a diameter of a disk of least confusion is defined, at least in part, by a position of the entrance aperture relative to the height of the first portion of the first L-shaped deflection plate.

8. The energy analyzer of claim 5, wherein a diameter of a disk of least confusion is defined, at least in part, by an aspect ratio of the length of the second portion of the first L-shaped deflection plate to the height of the first portion of the first L-shaped deflection plate.

9. The energy analyzer of claim 1, wherein the inhomogeneous electrostatic field is configured to produce small deflections to paths of particles entering the energy analyzer.

10. A charged particle spectrometer comprising:

a detector; and an energy analyzer comprising:

a first deflection plate, and a second deflection plate, wherein the first deflection plate and the second deflection plate are not symmetric, and wherein the first deflection plate and the second deflection plate generate an inhomogeneous electrostatic field between the first deflection plate and the second deflection plate when a voltage is applied to one of the first deflection plate or the second deflection plate.

11. The charged particle spectrometer of claim 10, wherein the first deflection plate is a first L-shaped deflection plate comprising a first portion having a height and a second portion having a length, wherein the height and the length are not equal.

12. The charged particle spectrometer of claim 11, wherein the second deflection plate comprises a second L-shaped deflection plate comprising a third portion and a fourth portion, the third portion substantially parallel to the first portion of the first L-shaped deflection plate and the fourth portion substantially parallel to the second portion of the first L-shaped deflection plate.

13. The charged particle spectrometer of claim 12, wherein the first portion of the first L-shaped deflection plate comprises an entrance aperture and third portion of the second L-shaped deflection plate comprises an exit aperture.

14. The charged particle spectrometer of claim 13, wherein a dimension of the exit aperture is less than a dimension of the entrance aperture.

15. The charged particle spectrometer of claim 10, wherein the energy analyzer is a small deflection energy analyzer.

16. The charged particle spectrometer of claim 10, wherein the detector is configured to detect ions or electrons.

17. An energy analyzer comprising:

a first deflector; and a second deflector, wherein the first deflector and the second deflector are not symmetric, and wherein the first deflector and the second deflector generate an inhomogeneous electrostatic field between the first deflector and the second deflector when a voltage is applied to one of the first deflector or the deflector.

18. The energy analyzer of claim 17, wherein the first deflector comprises an entrance aperture and the second deflector comprises an exit aperture.

19. The energy analyzer of claim 18, wherein a diameter of a disk of least confusion is defined by a position of the entrance aperture relative to a dimension of the first deflector and an aspect ratio of the first deflector.

20. The energy analyzer of claim 18, wherein a dimension of the entrance aperture is greater than a dimension of the exit aperture.

* * * * *